US006119441A

United States Patent [19]

Lipes et al.

[11] Patent Number: 6,119,441

[45] Date of Patent: Sep. 19, 2000

[54] AUTOMATIC BAGGING MACHINE

[75] Inventors: Arnold Lipes, Westmount; Bruno Wetter, Cote St. Luc, both of Canada

[73] Assignee: Glopak Inc., Montreal, Canada

[21] Appl. No.: 09/294,186

[22] Filed: Apr. 19, 1999

[51] Int. Cl.[7] ..... B65B 43/26

[52] U.S. Cl. ..... 53/570; 53/568; 53/384.1

[58] Field of Search ..... 53/570, 568, 384.1, 53/562, 531, 494, 571

[56] References Cited

U.S. PATENT DOCUMENTS

| | | | |
|---|---|---|---|
| 4,514,962 | 5/1985 | Ausnit | 53/568 |
| 5,301,492 | 4/1994 | Kader | 53/570 |
| 5,664,406 | 9/1997 | Smith | 53/570 |

FOREIGN PATENT DOCUMENTS 2141741 8/1996 Canada .

*Primary Examiner*—John Sipos
*Assistant Examiner*—Steven Jensen
*Attorney, Agent, or Firm*—David M. Carter; Guy Houle

[57] ABSTRACT

An automatic bagging machine is comprised of a discharge station for releasing one or more articles in an open top end of a plastic bag held thereunder. The machine is fed by a plurality of bags held side-by-side by a continuous top band portion. At the loading station, two clamping assemblies engage a respective top band portion at the top end of opposed side walls of the bag and a displacing mechanism moves the clamping assemblies on an angled path to a retracted position outwardly from one another on an angled path. Simultaneously a pivoting tension roll permits a predetermined length of the band portion and attached bag to be drawn towards the bag filling station to advance the plurality of bags whereby to permit the bag at the filling station to be opened by the two clamping assemblies. After the bag is filled it is displaced to a discharge station where the filled bag is disconnected from the continuous top band portions and released on a discharge conveyor. The bag discharge means simultaneously draws a next bag to be filled to the filling station. A turret having four compartments conveys the articles to the filling station and releases the articles into the open top end of the bag only if a proper number of articles is present in the compartment.

26 Claims, 8 Drawing Sheets

AUTOMATIC BAGGING MACHINE

TECHNICAL FIELD

The present invention relates to a bagging machine for inserting plastic film liquid pouches into an outer plastic bag and particularly, but not exclusively, to a bagging machine having a bag forming section to form bags from a single sheet of film stock.

BACKGROUND ART

Bagging machines to handle plastic bags having a liquid therein, such as milk pouches, are known in the art. For example, reference is made to U.S. Pat. No. 4,989,391, issued on Feb. 5, 1991 which shows milk pouches being conveyed, one at a time, to individualized compartments of a loading housing by means of pivoted guide plates and once the housing has received a correct number of pouches, usually three pouches, a trap door releases the pouch into a bag positioned thereunder. Such machines are usually loaded in sequence or in alternating sequence, as is known in the art. A disadvantage of such machines is that they have a relatively slow cycle time due to the fact that it takes time to fill the loading compartments of these machines as each pouch must be fed individually, in sequence, to a difference compartment. Thereafter the housing has to discharge its contents into a bag held thereunder through a trap door. The door then needs to be closed before other pouches can be loaded in the housing. Also, because the pouches are not always equidistantly spaced on the feed conveyors, the cycle time cannot be accelerated.

Reference is also made to Canadian patent application Ser. No. 2,141,741, published Aug. 4, 1996, and entitled "AUTOMATIC BAGGING MACHINE AND METHOD OF PLACING ARTICLES IN A BAG FORMED BY THE MACHINE AND CAPABLE OF SEALING THE BAG", which relates to an automatic bagging machine. However, such machine did not produce the intended results.

SUMMARY OF INVENTION

It is a feature of the present invention to provide an automatic bagging machine which substantially overcomes the above-mentioned disadvantages of the prior art.

According to another feature of the present invention there is provided an automatic bagging machine which is much faster than the prior art, and which includes a bag forming section in the machine whereby bags can be formed directly from roll stock, filled with a product and then conveyed to a tying machine and then discharged on a discharge conveyor, all automatically.

Another feature of the present invention is to provide an automatic bagging machine capable of identifying when improper number of liquid pouches are conveyed to the bagging station so that these are not placed in an outer bag but rejected or returned for future bagging.

According to the above features, from a broad aspect, the present invention provides an automatic bagging machine which comprises article discharge means for releasing one or more articles in an open top end of a plastic bag held at a bag filling station by displaceable clamp means. There is provided a plurality of bags conveyed by the machine and disposed side-by-side and depending from continuous top band portions. Each bag has opposed side walls each having a top band portion at a top end thereof, opposed vertical sealed edges extending from a sealed bottom edge of the bag to the top band portions and terminating at a lower edge of the top band portions. The displaceable clamp means has two clamping assemblies to clamp a respective one of the top band portions. Each assembly is secured to a clamp displacing mechanism for moving the clamping assemblies to a retracted position outwardly from one another on an angled path. Bag advancing means is synchronized with the clamp displacing mechanism for causing a predetermined length of the plurality of bags to advance to the bag filling station to permit the bag at the bag filling station to be opened by the two clamping assemblies. Bag discharge means is provided for displacing a filled bag from the filling station to a discharge station where the filled bag is disconnected from the continuous top band portions and released. The bag discharge means also draws a next bag of the plurality of bags to the bag filling station.

According to a further broad aspect of the present invention the automatic bagging machine is provided with a bag forming section whereby to form the plurality of bags from a roll of plastic film stock material.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
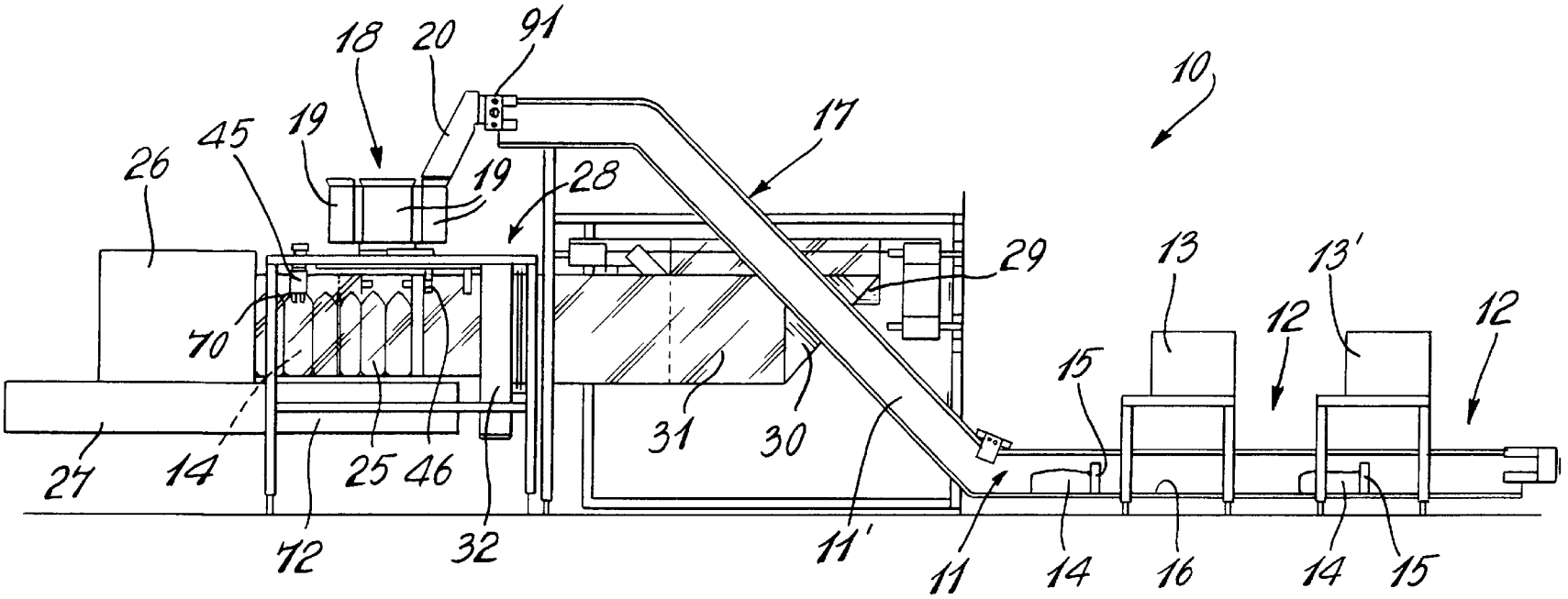
FIG. 1 is a side view of the automatic bagging machine of the present invention being fed by two collating bagging machines of a type known in the prior art.
Figure 2:
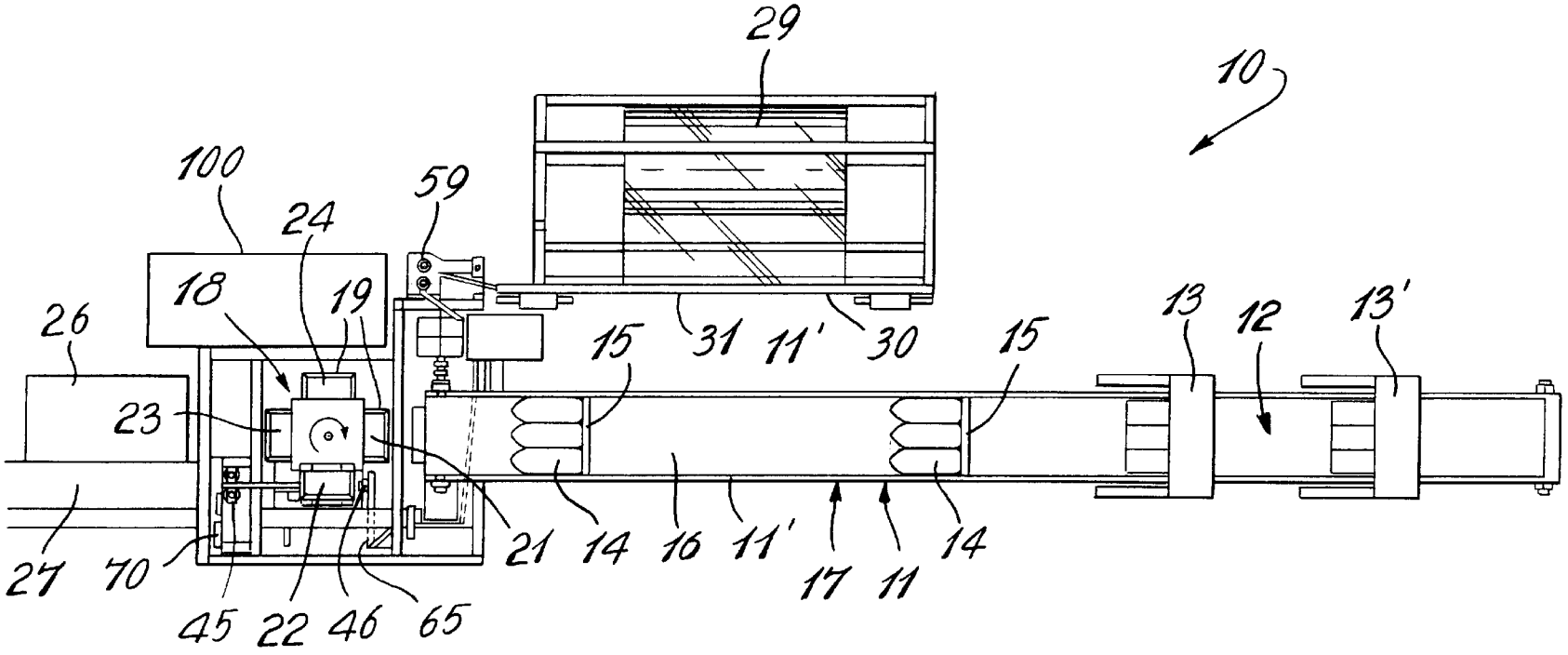
FIG. 2 is a top view of FIG. 1.

Referring now to the drawings and more particularly to FIGS. 1 and 2, there is shown generally at 10 the automatic bagging machine of the present invention. The machine comprises a feed conveyor 11 having a loading end 12 where two collating bagging machines 13 and 13' release groups of liquid pouches 14, herein three milk pouches, in a side-by-side relationship on the feed conveyor 11 and in front of pusher plates 15, there being a plurality of pusher plates equidistantly spaced along the support conveying surface 16 of the conveyor 11. The feed conveyor 11 has a steep incline section 17 which ensures that each group of three pouches 14 are in abutment with the pusher plates 15 prior to releasing same into an article discharge turret 18 comprised of four diametrically secured article carrying compartments 19.

As shown more clearly in FIG. 2, the article discharge turret 18 displaces the compartments 19 to four diametrical positions and in an indexed manner. Firstly, the group of articles 14, as hereinshown, is discharged and guided by the guide chute 20 into a compartment positioned at an article loading station 21. The turret is then indexed to displace the compartment 19 to the next station and namely a bag filling station 22 where the group of pouches 14 are released in a bag 25 (see FIG. 1) positioned thereunder and through its open top end ready to receive the pouches. The turret then displaces the compartment to an intermediate station 23 and then to an unloading station 24 where rejected pouches are released and conveyed for recycling back to the infeed conveyor or elsewhere when an improper number of pouches is in the compartment. The filled bag as shown at 25', in FIG. 1, is then fed into a top end gathering and fastener applying machine 26 where the top end of the outer bag is closed and then released on an exit conveyor 27. The machine 26 may also be a sealing machine where the top end of the bag in a gathered or flat state is heat-sealed by sealing bars or pins.

As hereinshown the machine also has a bag forming station, generally indicated at reference numeral 28, whereby to form a series of bags, as will be described later, from a single roll 29 of film stock material. The film sheet is folded in half by a folding plate 30, in a manner well known in the art. A more detailed description of the automatic bagging machine of the present invention now follows.

Figure 6:
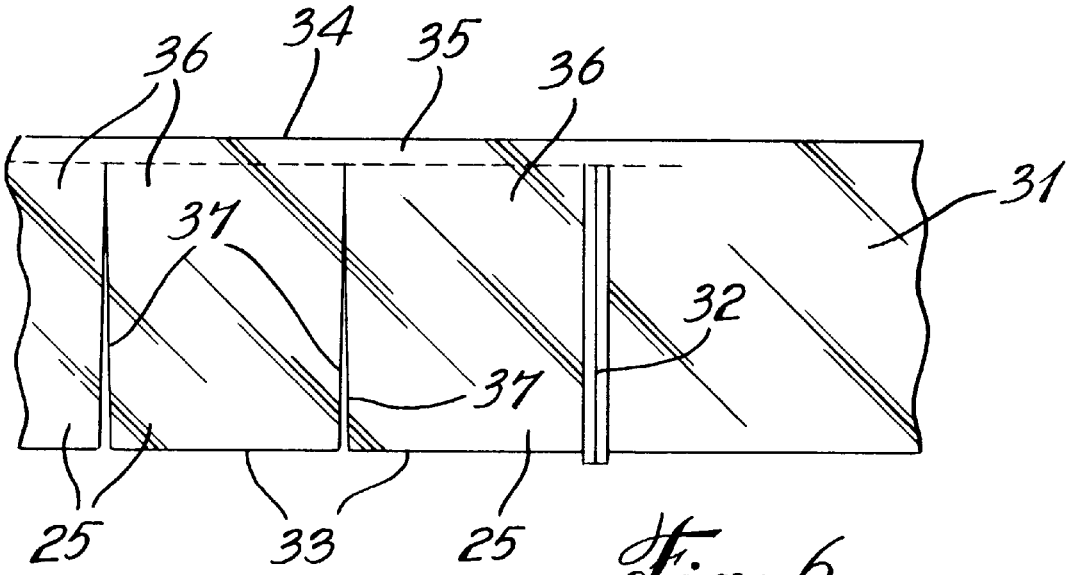
FIG. 6 is a fragmented side view showing plastic bags being formed in a folded film sheet while simultaneously forming a continuous top band portion for conveying the bags.
Figure 7:
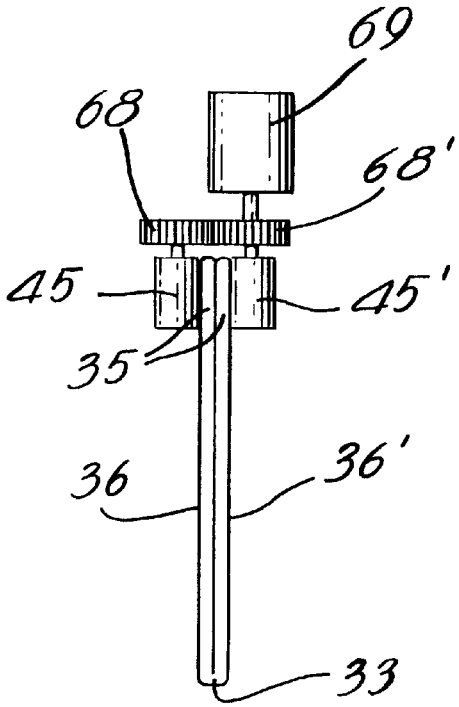
FIG. 7 is a section view of the bag discharge and drawing rolls.

As above-mentioned, the bag forming section of the machine forms a series or plurality of bags 25 from a folded film sheet 31 and this is accomplished by conveying the folded film sheet 31, as shown in FIG. 6, to a vertical hot bar 32 which is advanced against the folded film sheet 31 to sever the folded film sheet between a folded bottom edge 33, which constitutes a sealed bottom edge, and spaced from a top edge 34 of the folded film sheet a predetermined distance to form opposed continuous top band portion 35 throughout the film sheet and extending in a top portion of opposed side walls 36 and 36', see FIG. 7, of the bag being formed. As the hot bar severs the folded film sheet it also forms a vertical sealed edge 37 in opposed bags 36. Accordingly, the bag forming section of the machine of the present invention supplies and conveys a plurality of bags 25 which are disposed side-by-side and which depend from continuous top band portions.

Figure 3:
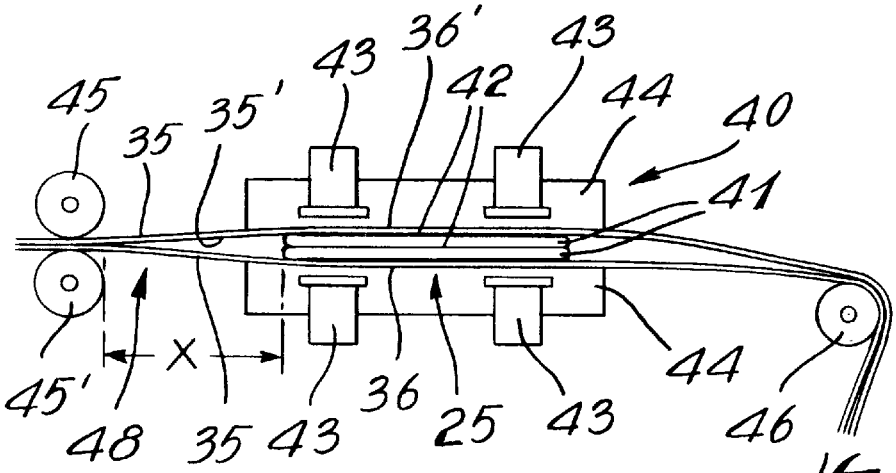
FIG. 3 is a simplified top sectional view showing the continuous top band portions of the plastic bags at the bag filling station and prior to being separated to open a plastic bag to receive pouches therein.

Referring now to FIGS. 3 to 5, 9 and 10, there will be described the clamping assemblies 40 which are disposed at the filling station 22 to open the top end of each plastic bag 25 conveyed thereunder. As shown in FIG. 3, there are two clamping assemblies 40 and each of the assemblies is comprised of an inner clamp plate 41 having an outer clamping surface 42 over which a section of an inner surface 35' of the top band portion 35 of one of the opposed side walls 36 and 36' of the bag 25 is positioned. An outer actuable clamping means, constituted by two piston actuated clamp blocks 43, are supported on the frame 44 of each of the clamping assemblies and are in a retracted position prior to the bag clamping and opening cycle, as shown in FIG. 3.

A bag discharge and draw means in the form of a pair of rolls 45 and 45' engage the continuous top band portions 35 in juxtaposed clamping manner and draws the bands and the bags depending thereunder into the clamping assemblies 40 with the two clamp plates 41 positioned together in juxtaposition, as shown in FIG. 3. Accordingly, the bag thereunder is in a collapsed condition.

Figure 4:
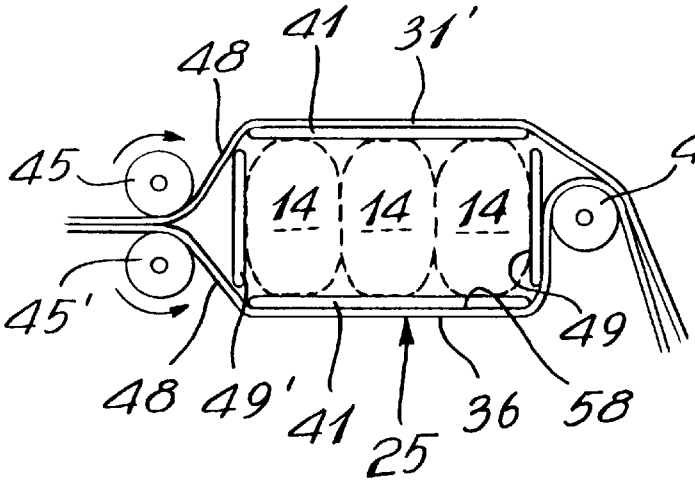
FIG. 4 is a view similar to FIG. 3 but showing the top end portion of the bag being open with three pouches inserted therein.
Figure 5:
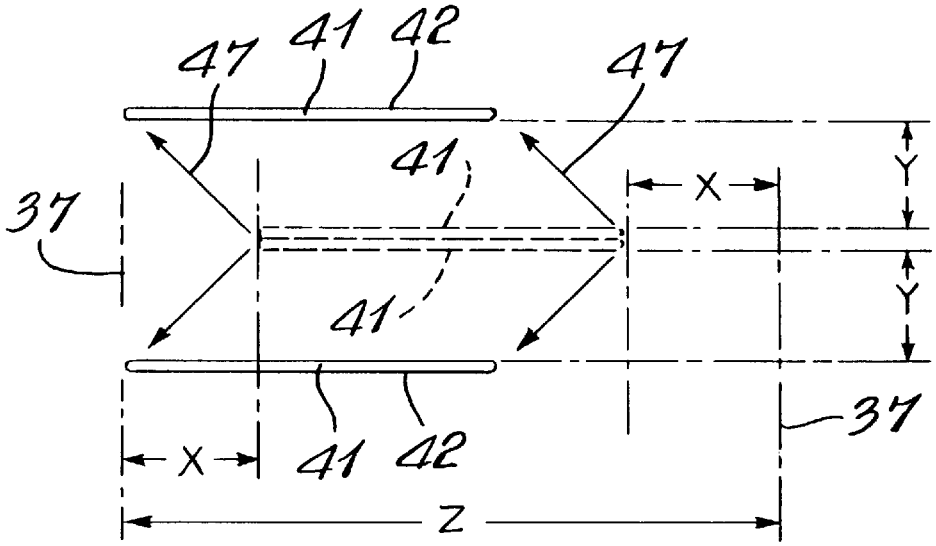
FIG. 5 is a schematic view showing the displacement of the clamping plates of the two clamping assemblies and the relationship with respect to one another during their angulated displacement to open the top end of a plastic bag.

With reference now to FIG. 5, there will be described the bag opening cycle. It can be seen that the clamping plates 41, as shown in phantom lines, are shorter than the width Z of the bag by the distance 2X whereby to permit the top end portion of the bag to be opened, as shown in FIG. 4, without stretching the continuous band portions and causing it to rip. To achieve this bag opening, there is also provided a bag advancing means in the form of a displaceable tension roll 46 capable of causing a length of bands and consequently a bag to advance a distance 2X while the inner clamp plates are moved outwardly, as shown in FIG. 5, to open the bag. As illustrated schematically in FIG. 5, the inner clamp plates 41 and the entire clamping assembly comprising the clamp blocks and their support frame 44 are caused to move to a retracted position outwardly from one another on an angled path 47 of 45° as the front end 48 of the bag 25 is held stationary by the draw rolls 45 and 45' which are arrested during the bag opening and filling cycle. This is the reason why the bag tension roll 46 is displaced from its tension position, as shown in FIG. 3, to its release position as shown in FIG. 4 to permit the plates 41 to pull the predetermined length of film sheet which is equal to 2X when the plates separate.

As shown in FIG. 5, when the clamp plates 41 are in the juxtaposed position as shown in phantom line, they are positioned substantially equidistantly spaced from opposed side edges 37 of the bag a distance "x" which is substantially equal to the distance "y" between the opposed side walls 36 and 36' when the side walls of the bag are separated by the plates 41. Each of the plates move outwardly along the angle path 47 so that the bag may assume an open condition, as shown in FIG. 4. After the bag is opened, end guide plates 49 and 49' are hinged into the open end of the bag between the inner clamp plates 41 by respective cylinders 48 and 48' (see FIG. 12) to configure the bag with an open end sufficiently large to receive a group of three liquid pouches 14 therein.

Figure 9:
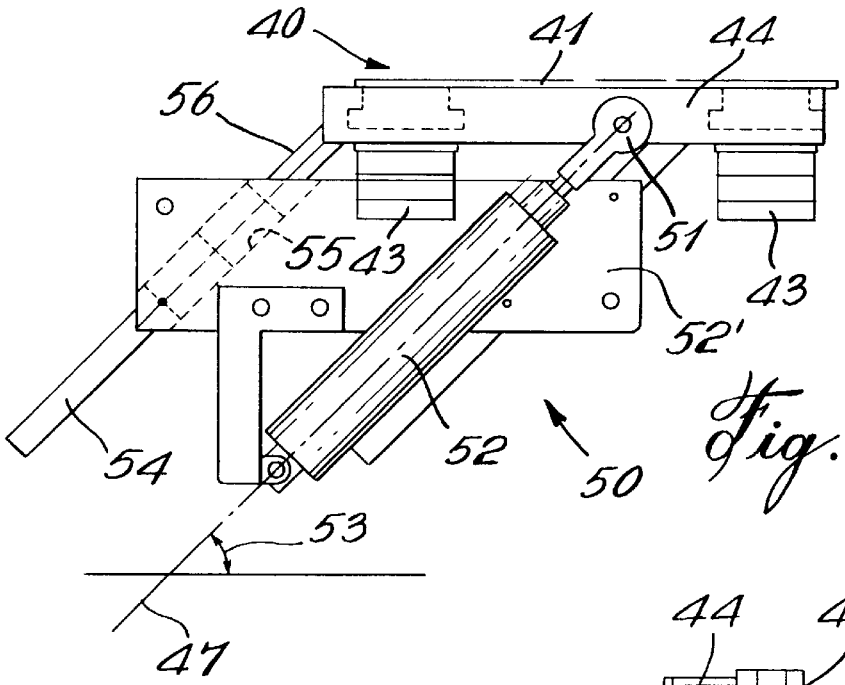
FIG. 9 is a simplified top fragmented view illustrating the construction of the clamp assembly displacing mechanism.
Figure 10:
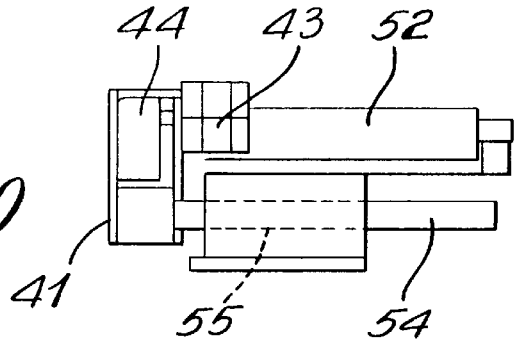
FIG. 10 is a side end view of FIG. 9.

Referring now to FIGS. 9 and 10, there is illustrated the construction of the angulated clamp displacing mechanism 50. It consists of two of the mechanisms 50, only one being shown herein and positioned on each side at the filling station 22. Each mechanism 50 comprises a piston rod end 51 secured to the frames 44 and actuable by a piston 52 secured to a stationary frame 52' to displace the support frame 44 and the clamping assembly 40 on an angulated axis 47, as previously described. A guide rod 54 is also received within a guide bore 55 in the frame 52 and secured at one end 56 to the frame 44 to assure that the frame 44 is always maintained in the same plane with the plates 41 parallel to one another.

Referring again to FIG. 4, it is pointed out that the end guide plates 49 and 49' are pivotally displaceable into the open top end 58 of the bag 25 when the clamping assemblies 40 are displaced to the full retracted position, as shown in FIG. 9. As previously described a displaceable tension roll 46 is displaced to permit a predetermined length of the plurality of bags and the top band portions to be drawn to the filling station during the bag opening cycle by the movement of the plates 41 away from one another.

Figure 13:
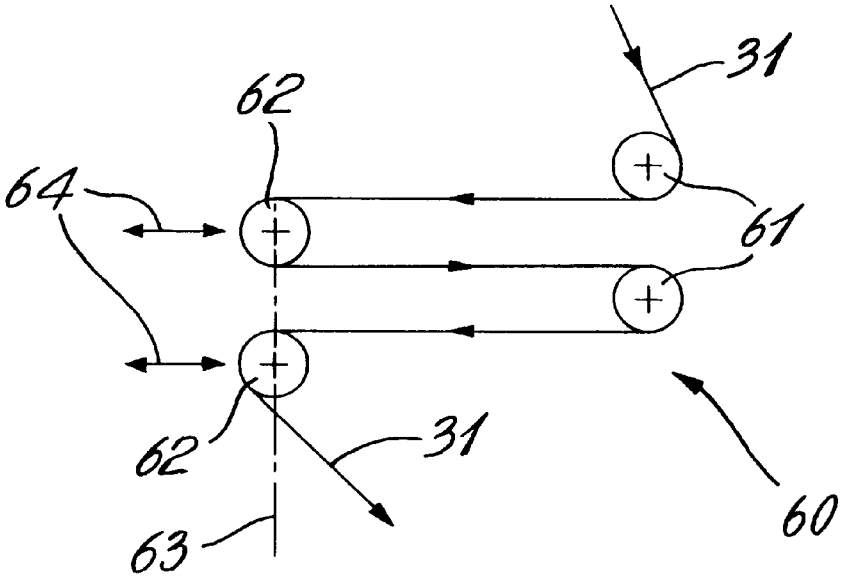
FIG. 13 is a simplified schematic view showing the construction of the dancer roll assembly for storing a predetermined length of the juxtaposed film sheet prior to forming the bag.

With further reference now to FIG. 13, there is shown a dancer roll assembly 60 which is continuously fed the folded film sheet 31 from the roll stock 29 by feed rolls 59, as shown in FIG. 2. The dancer roll assembly 60 consists of two or more dancer rolls 61 which are immovably secured and a pair of take-up rolls 62 which are mounted on a pivoted frame, herein schematically illustrated by a frame axis 63, to move the take-up rolls 62 in the direction of arrows 64 when the draw rolls 45 and 45' and the pivoting tension roll 46 are stopped during a bag filling cycle. Accordingly, the feed rolls 59 continue to draw film from the roll of film stock 29 and this additional folded film sheet is taken up by the displacement of the take-up roll 62.

As the open top end of the bag at the filling station is being opened by the plates 41, the clamping assemblies draw the predetermined length 2X of folded film from the pivoting tension roll 46 which moves into its position as shown in FIG. 4. The amount of film spanning the distance between the plates 41 to the tension roll 46 as shown in FIG. 3 is equal to 2X. The draw rolls 45 and 45' are stationary during the bag opening cycle. After the bag filling cycle, the plates 41 come back together and at the same time the tension roll 46 pivots back to its position as shown in FIG. 3. The dancer roll assembly is accumulating folded film during this plate return cycle. After the plates are back together, the draw rolls 45 and 45' start drawing film at a fast rate to take up film accumulated in the dancer roll assembly. The feed rolls 59 unwind film at a constant rate which is calculated by the width of the bag multiplied by the number of bags filled per minute. The draw rolls 45 and 45' accordingly operate at a much faster speed to compensate for the idle time during bag filling which includes the displacement of the plates 41.

Figure 11:
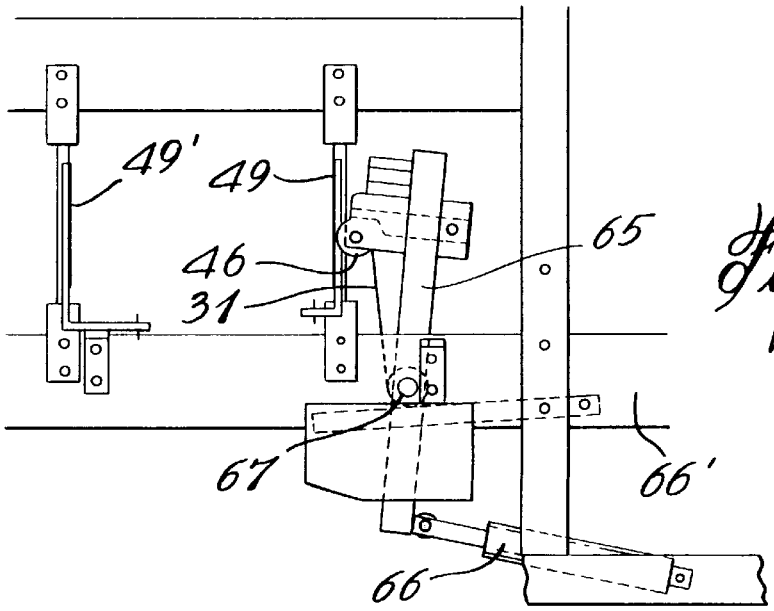
FIG. 11 is a top view showing the construction of the bag drawing mechanism synchronized with the clamp displacing mechanism for advancing a predetermined length of the continuous top band portions and hence the bags to the bag filling station.
Figure 12:
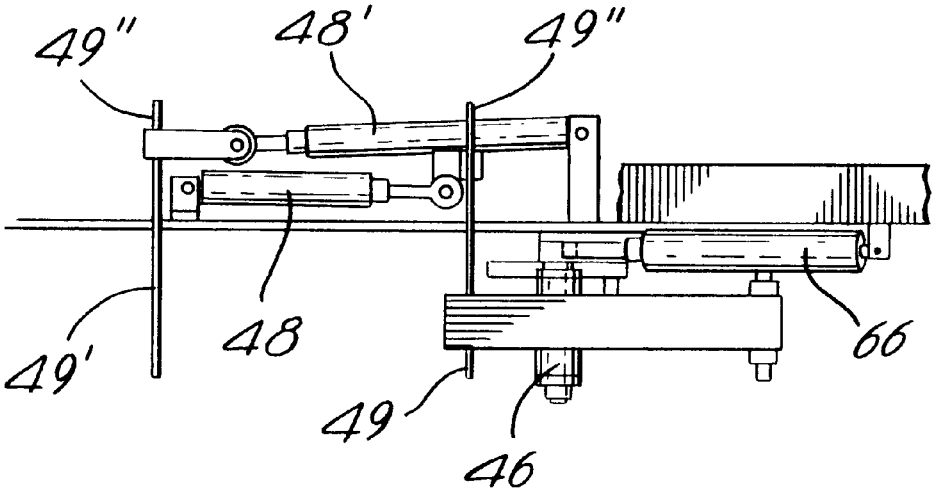
FIG. 12 is a side view of FIG. 11 and partly fragmented.

Referring to FIGS. 11 and 12, there is shown the construction of the displaceable tension roll mechanism and it comprises a pivoting frame 65 which supports the tension roll 46. The frame 65 is pivotally connected to frame 66 by a pivot connection 67. The pivoted frame 65 is actuated by a cylinder 66 which is operated in synchronism with the angulated clamp displacement mechanism 50, as shown in FIG. 9. The displaceable tension roll 46 will abut the end guide plate 49 to maintain the open top end 58 of the bag 25 properly engaged when the liquid pouches 14 are dropped therein.

Figure 8:
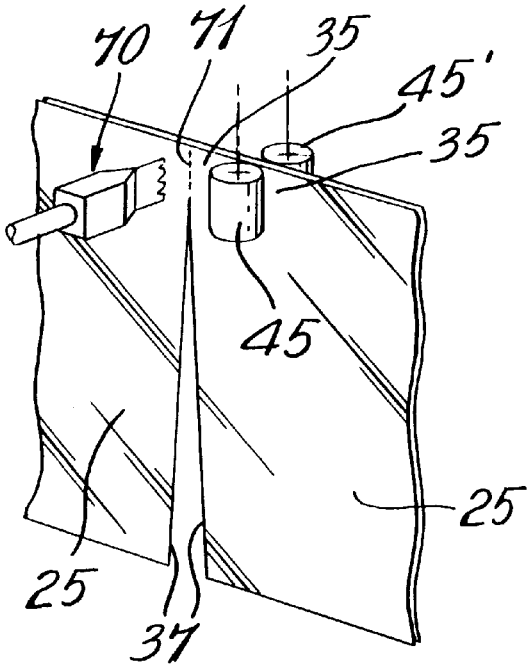
FIG. 8 is a perspective view showing the top bands severing knife in relation to the discharge and drawing rolls.

With reference now to FIGS. 1, 7 and 8, it can be seen that the draw rolls 45 and 45' are each coupled to a pair of gears 68 and 68', respectively, with one of the gears, herein gear 68', being rotated by an indexing motor 69 to impart a predetermined rotation to the draw rolls 45 and 45' to advance the continuous top band portion and the filled bag, as shown in FIG. 4, to locate same to a discharge position, as shown in FIG. 8. At that discharge position, a severing means in the form of a piston actuated blade 70 cuts the top band portions 35 in the area 71 and disconnects the filled bag 25' from the top band portion 35. Simultaneously the next bag 25 to be filled is positioned adjacent the filling station and a discharge belt conveyor 72 under the filling station is operated to transfer the filled bag into the fastener applying machine 26.

Figure 14:
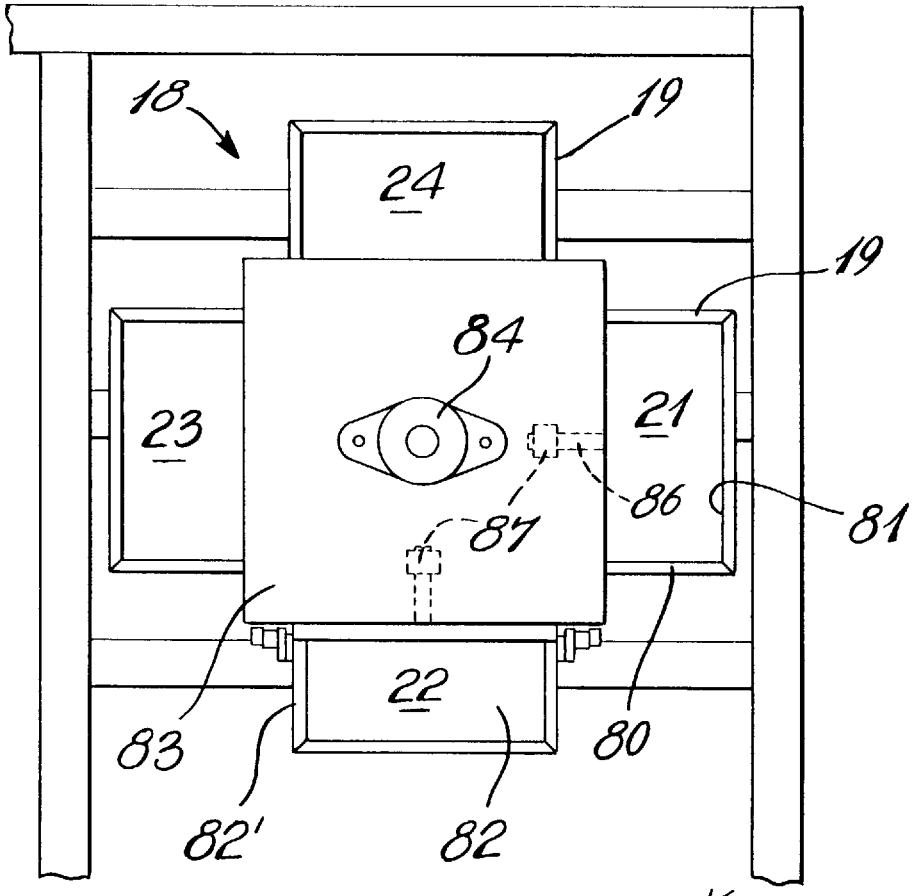
FIG. 14 is a top view of the article discharge turret and its compartments.
Figure 15:
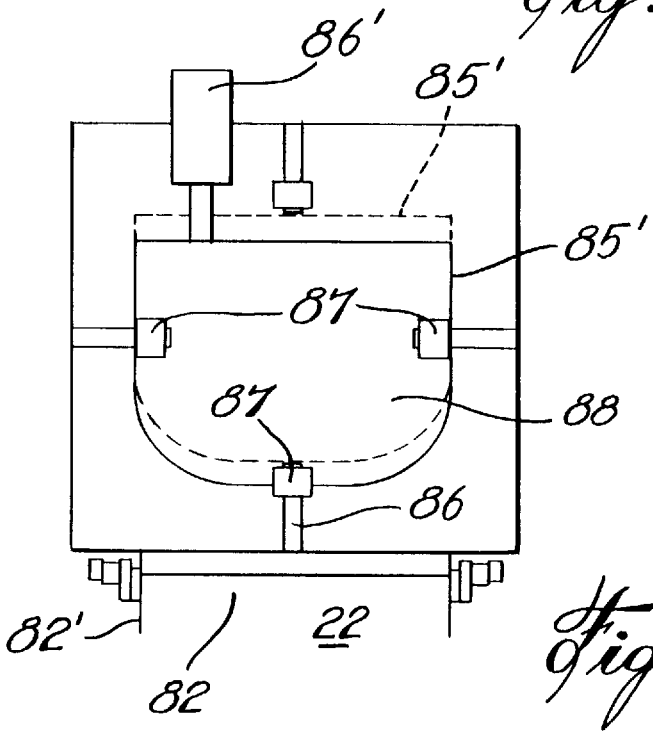
FIG. 15 is a bottom view showing the construction of the release plate.

Referring now to FIGS. 14 and 15, there is shown an enlarged top view and bottom view, respectively, of the article discharge turret 18. As previously described, the turret 18 is provided with four rectangular compartments 19 and each displaceable from an article loading station 21 to a bag filling station 22 and then to an intermediate station 23 and an unloading station 24, and the cycle repeats again. Each compartment 19 is provided with a circumferential side wall 80 configured to receive the group of liquid pouches, herein milk pouches, in substantially close fit therein so that the pouches maintain their orientation with respect to one another. The compartments, as shown, are of rectangular cross-section. Each compartment is also provided with an open top end 81 and a bottom trap wall 82. The article discharge turret platform 83 is displaced to these stations by an indexing motor 84 synchronized with the draw roll indexing motor 69.

Figure 16A:
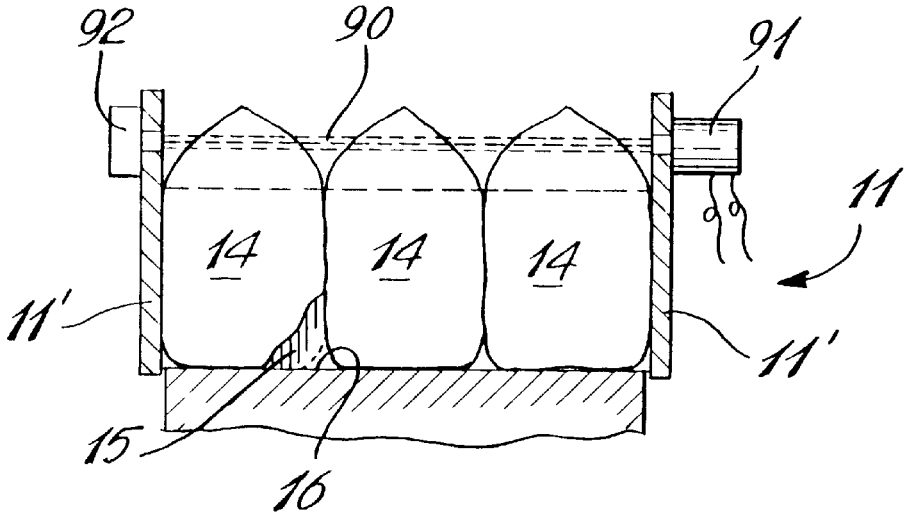
FIGS. 16A and 16B are section views of the conveyor illustrating the construction of the presence detector to detect that the conveyor has three pouches thereon to discharge in a compartment of the turret.
Figure 16B:
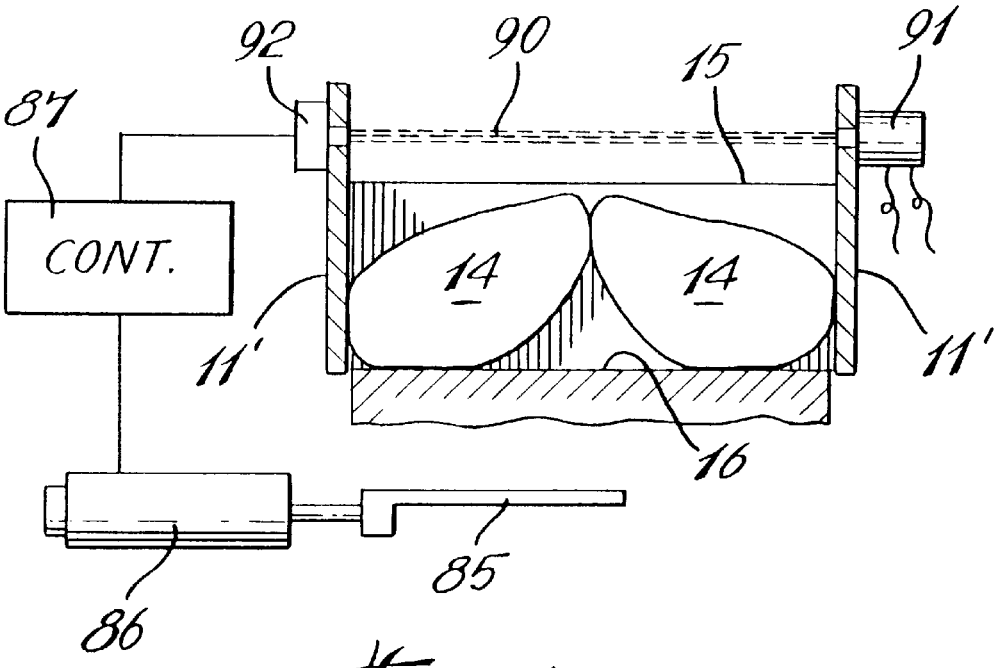

As shown in FIG. 15, which is a view from under the article discharge turret 18, there is provided a control plate 85 which is connected to a cylinder 86 which is operated by a control circuit 87, see FIG. 16B, which controls the cylinder 86 which displaces this control plate to cause the bottom trap wall 82 to open when disposed at the discharge station 22. As shown in FIG. 15, when the cylinder 86 retracts the control plate to its position 85' as shown in phantom lines, the trap door support rod 86 which is provided with a roller 87 at an end thereof, is released from its support by the control plate 85. The roller 87 is no loner in contact with the plate 85 and this causes the trap door, with the load thereon, to automatically release above the open end 58 of the open bag 25 and drop the pouches in the open end of the bag 25 at the filling station 22, as shown in FIG. 1.

As shown in FIG. 12, the side plates 49 and 49' extend in a top section 49" thereof to guide the pouches on their sides as they are released into the open end of the bag and the trap door also extends between these side plate extensions 49" to provide further guidance of the pouches. Each time the compartment 19 reaches its position at the filling station 22 the trap door opens when there are three pouches in the compartment. Thereafter, the bottom trap wall 82 remains depending with the roller 87 and shaft 86 having been raised vertically in front of the control plate 85. Accordingly, the bottom trap wall 82 remains depending until it is moved from the discharge position 24 towards the loading position 21. At that moment, the leading edge 82' (see FIG. 14) of the bottom trap wall 82 will abut the rear edge 85' of the control plate 85 which is in its path and this abutment will cause the trap door to hinge to a closed position and be supported on the top surface 88 of the control plate. This operation is performed without interruption of the displacement of the compartments. Accordingly, the article discharge turret 18 always remains in operation.

With reference now to FIGS. 16A and 16B, there will be described detecting means in the form of a light sensing beam 90 which is provided in a top end portion of the feed conveyor 11 whereby to detect that there are three pouches 14, in each group of pouches, being conveyed to the article discharge turret by the pusher plates 15 of the conveyor 11. As shown in FIG. 16A, an infrared beam transmitter 91 is positioned close to the top of the side guide walls 11' of the conveyor 11 and directs a light beam across the conveyor to the opposed side wall 11' where a detector 92 is secured. If the pouches 14 are correctly oriented in a side-by-side longitudinal relationship, then this will be detected by the light beam and no signal will be received at the detector. This means that the group contained three pouches.

Referring now to FIG. 16B, it can be seen that in the event that the collating bagging machines 13 did not discharge three pouches, and as hereinshown only two pouches having been discharged, then these pouches will have more space to collapse on the top conveying surface 16 of the conveyor and lie much lower on the conveying surface 16. Accordingly, the infrared light beam 90 will be received at the detector 92 which will feed a signal to the control circuit 87 informing the control circuit that the incoming group of pouches being discharged in the compartment 19 at the article loading station 21 contains an improper quantity of pouches and should not be released at the filling station 22. Accordingly, the control circuit 87 will send a signal to the cylinder 86' or other control circuit causing the cylinder 86' not to operate. The bottom trap wall 82 will not release and the roller 87 will maintain its engagement with the top surface 88 of the control plate 85 throughout its travel until it reaches the unloading station 24 where the roller 87 will no longer engage with the control plate 85 due to the shape of the plate and cause the two or one pouches contained therein to be released onto a return conveyor (not shown) whereby the pouches may be recycled back into the collating bagging machines 13 and 13'.

As shown in FIG. 2 an electrical housing 100 is provided in which all electrical devices and control circuits are located. Although not shown, a control panel is also made accessible to the operator to intervene with the control circuits should the operator wish to stop or control the automatic bagging machine 10. Although not described in detail, the various aspects of this machine are all synchronized and the automatic bagging machine can operate automatically at a constant speed regardless if improper quantities of liquid pouches are released on the feed conveyor 11. When this occurs, the draw rolls 45 and 45' at the bag forming station will stop and the take-up rolls 62 in the dancer roll assembly 60 will accumulate film until the rolls 62 reach a maximum displacement at which the feed rolls 59 will stop. Accordingly, there is no waste of the product and the bags.

It is within the ambit of the present invention to cover any obvious modifications of a preferred embodiment described herein, provided such modifications fall within the scope of the appended claims.

What is claimed is:

1. An automatic bagging machine comprising article discharge means for releasing one or more articles in an open top end of a plastic bag held at a bag filling station by displaceable clamp means within said bag, there being a plurality of bags conveyed by said machine and disposed side-by-side and depending from continuous top band portions, each bag having opposed side walls with one of said top band portions at a top end of a respective side wall, opposed vertical sealed edges extending from a sealed bottom edge of said bag and terminating at a lower edge of said top band portions, said displaceable clamp means having two clamping assemblies and clamp displacing mechanisms for moving said clamping assemblies and for moving clamping assemblies within said bag held at the bag filling station along an angled path from a first position to a second position outward and downstream of the first position to permit filling of said bag, bag advancing means synchronized with said clamp displacing mechanisms for causing a predetermined length of said plurality of bags to advance to said bag filling station to permit said bag at said bag filling station to be opened by said two clamping assemblies, and bag discharge means for displacing a filled bag from said filling station to a discharge station where said filled bag is disconnected from said continuous top band portions and released and to simultaneously advance a bag to said bag filling station, said bag discharge means also drawing a next bag of said plurality of bags to said bag filling station.

2. A bagging machine as claimed in claim 1 wherein each of said clamping assemblies comprises an inner clamp plate of predetermined length and having an outer clamping surface over which an inner surface of a top band portion of one of said opposed side walls of said bag is positioned, and outer actuable clamp means for clamping said top portions on said outer clamping surface of said inner clamp plate, said inner clamp plates of both said two clamping assemblies being held together in juxtaposition when said bag discharge means draws said next bag to be filled to said bag filling station.

3. A bagging machine as claimed in claim 2 wherein each inner clamping plates are shorter than the width of said bag side wall and positioned substantially equidistantly spaced from opposed side edges thereof a distance which is substantially half the distance between said opposed side walls when held in an open position by said clamping assemblies to create said open top end.

4. A bagging machine as claimed in claim 3 wherein said outer actuable clamp means is constituted by at least one piston actuated clamp block supported on a frame of each said clamping assembly.

5. A bagging machine as claimed in claim 4 wherein said clamp displacing mechanism comprises angulated guide means secured to said frame for guiding said frame along said angled path, said angled path lying at an angle of 45° with respect to the plane of said clamp plates, and a piston rod end secured to said frame for imparting displacement of said frame along said angled path to displace said clamping assemblies to and away from said bag filling station to cause said bag top end to open.

6. A bagging machine as claimed in claim 5 wherein there are two of said at least one piston actuated clamp blocks disposed spaced apart from one another.

7. A bagging machine as claimed in claim 1 wherein said article discharge means is comprised of a turret transport mechanism having four article receiving compartments, each compartment having a circumferential side wall, an open top end and a bottom trap wall; means to displace said compartments in a synchronized manner from an article loading station, said bag filling station, an intermediate station and an unloading station; said one or more articles being discharged from said compartment into said open top end of said plastic bag at said filling station by opening said bottom trap wall of said compartment.

8. A bagging machine as claimed in claim 7 wherein said one or more articles is constituted by three liquid pouches.

9. A bagging machine as claimed in claim 8 wherein there is further provided a feed conveyor for feeding spaced-apart groups of said three liquid pouches to said open top end of said compartment at said article loading station with said liquid pouches oriented in side-by-side lengthwise relationship, said feed conveyor being driven at a speed synchronized with said means to displace said compartments.

10. A bagging machine as claimed in claim 9 wherein there is further provided detection means along said feed conveyor to detect the presence of three liquid pouches in each said group, and control means to prevent discharge of said compartment at said filling station when said control means receives a signal from said detection means that said group of liquid pouches in said compartment at said filling station does not contain three liquid pouches.

11. A bagging machine as claimed in claim 10 wherein said control means is a control circuit which controls a cylinder which causes actuation of a control plate to release said bottom trap wall of said compartment at said filling station only when said compartment contains said three liquid pouches and to prevent said bottom trap wall to open when there is less than three liquid pouches in said compartment at said filling station.

12. A bagging machine as claimed in claim 7 wherein there is further provided automatic trap door closing means to cause said trap door of said compartment to close when said compartment is displaced from said unloading station to said article loading station.

13. A bagging machine as claimed in claim 12 wherein said trap door closing means is an abutment edge of said control plate positioned under said compartment and disposed along a path of displacement of said compartment from said article loading station to said bag filling station to obstruct and cause pivoting upward displacement of said trap door.

14. A bagging machine as claimed in claim 9 wherein said feed conveyor is a belt conveyor having spaced-part pusher plates, said feed conveyor being fed said groups of pouches by two pouch collating and grouping machines disposed above said belt conveyor at a loading end of said belt conveyor.

15. A bagging machine as claimed in claim 14 wherein said belt conveyor is provided with a steep inclined section to cause said group of liquid pouches to position themselves against said pusher plates to ensure proper spaced-part grouping prior to discharge of said pouches into said compartment at said loading station.

16. A bagging machine as claimed in claim 15 wherein there is further provided guide means interposed between a top discharge end of said feed conveyor and said open top end of said compartment at said loading position to maintain said three liquid pouches in side-by-side relationship.

17. A bagging machine as claimed in claim 8 wherein said three liquid pouches are milk pouches.

18. A bagging machine as claimed in claim 1 wherein there is further provided a bag forming section for forming said plurality of bags from a film roll.

19. A bagging machine as claimed in claim 18 wherein said bag forming section comprises a film folding plate for folding a film sheet drawn from said film roll to form two juxtaposed film sheets, feed rolls for engaging and drawing said two juxtaposed film sheets at a predetermined constant uninterrupted speed, a dancer roll assembly for storing a predetermined length of said juxtaposed film sheet fed by said feed rolls and having means to store a predetermined length of said juxtaposed film sheet during a bag opening and filling cycle of said machine, and a bag former between said dancer roll assembly and said bag filling station.

20. A bagging machine as claimed in claim 19 wherein said bag former is comprised of a vertical hot bar which is displaceable against said folded film sheet at predetermined intervals to sever said folded film sheet between a folded bottom end thereof which constitutes said sealed bottom edge and spaced from a top edge of said folded film sheet to form said continuous top band portions, said vertical hot bar simultaneously forming a sealed vertical edge in opposed side edges of said bags.

21. A bagging machine as claimed in claim 19 wherein there is further provided a pair of end guide plates pivotally displaceable into said open top end of said bag when said clamping assemblies are displaced to said retracted position for guiding said articles in said bag through said open top end.

22. A bagging machine as claimed in claim 1 wherein said bag advancing means is comprised of a pivoting tension roll which permits advancement of said predetermined length of said plurality of bags from said bag former to said bag filling station when said bag is being opened by said clamping assemblies.

23. A bagging machine as claimed in claim 22 wherein said pivoting tension roll is displaced for pivotal movement against one of said end guide plates.

24. A bagging machine as claimed in claim 19 wherein said bag discharge means is comprised of a pair of gear coupled draw rolls driven by an indexing motor, and an index driven discharge conveyor synchronized with said clamp rolls.

25. A bagging machine as claimed in claim 24 wherein there is further provided severing means for cutting said top band portion and positioned immediately after said clamp rolls for detaching said filled bag from said plurality of bags attached to said continuous top bands, said discharge conveyor discharging said filled bag into a bag top tying or sealing machine where a top end portion of said filled bag is gathered and tied at said gathered end or heat-sealed with a gathered or flat seal before being released on a conveyor means.

26. A bagging machine as claimed in claim 22 wherein said bag discharge means comprises a pair of draw rolls to draw a folded bag of said plurality of bags to said bag filling station.

* * * * *